United States Patent [19]

Tanaka

[11] 4,228,977

[45] Oct. 21, 1980

[54] KITE

[76] Inventor: Yasuo Tanaka, 320 Oaza Murata, Washima-mura, Santo-gun, Niigata-ken, Japan

[21] Appl. No.: 8,333

[22] Filed: Jan. 31, 1979

[51] Int. Cl.[3] ..... B64C 31/06

[52] U.S. Cl. ..... 244/153 R; D21/88; 43/2; 46/124

[58] Field of Search ..... 244/153 R, 154; 43/2, 43/3; D21/87–89; 46/76R, 79, 80, 124

[56] References Cited

U.S. PATENT DOCUMENTS

| | | | |
|---|---|---|---|
| 2,461,465 | 2/1949 | Chu et al. | 244/153 R |
| 2,744,702 | 5/1956 | Briggs | 244/154 |
| 2,870,567 | 1/1959 | Bergstrand | 46/76 R |
| 3,787,998 | 1/1974 | Kilroy et al. | 46/79 |

*Primary Examiner*—Barry L. Kelmachter

*Attorney, Agent, or Firm*—Wenderoth, Lind & Ponack

[57] ABSTRACT

A kite simulating an actual flying thing such as a bird comprises a central body of light material and a pair of wings easily attached to and detached from the central body, each of the wings being provided with two projections orthogonal with respect to each other so that one is inserted into the body in a direction substantially traversing the longitudinal axis of the body and the other is inserted into the body in a direction substantially parallel to the longitudinal axis of the body for fixing the wing to the body. The skeleton of the wing is constructed of flexible material so that it flaps during its flying operation.

7 Claims, 6 Drawing Figures

KITE

FIELD OF THE INVENTION

This invention relates to a kite and more particularly to a kite of a special configuration having a main body of a solid or three dimensional shape and a pair of wings symmetrically and laterally extending from the body to resemble a shape such as a bird.

BACKGROUND OF THE INVENTION

Heretofore, kites have been fabricated in various shapes for the purpose of presenting an attractive appearance. However, almost all of the kites have been given sheet-like surfaces which may be plane or curved to effectively receive air pressure thereon.

Although in the field of play things, toys, models, etc., articles having a shape resembling or simulating the actual thing such as airplanes, trains, animals, etc. have been placed in the market, kites having a shape substantially resembling actual things have not been available. This is because, in order to fly the kite, the entire kite including its skeleton should be fabricated as light as possible relative to its total area subjected to air pressure.

Further, even if a kite is presented in the shape of a bird, flapping of the wings in a manner similar to that of a bird has been considered difficult to attain since it was assumed that mechanical means for effecting such flapping was necessary and this would increase the weight of the kite. Therefore, a kite having a shape substantially simulating an actual bird has not been provided.

SUMMARY OF THE INVENTION

Accordingly, it is an object of this invention to provide a kite substantially simulating an actual flying creature.

It is also an object of this invention to provide a kite including a central body of a solid or three dimensional shape and a pair of wings each of which extends from opposite sides thereof symmetrically from the central body.

It is a further object of this invention to provide a kite of a bird shape the wings of which flap in a manner similar to that of the actual bird.

It is still another object of this invention to provide a kite of the above type wherein the wings are easily attached to and detached from the central body.

According to the present invention, the above objects are attained by forming the central body from light material such as foamed polystyrol, making the wings flexible enough to flap under wind pressure and providing coupling means between the central body and wings, the coupling means allowing the wings to be easily attached to and detached from the central body. In the preferred embodiment according to this invention, the wing has two projections to be received in the central body in substantially two directions orthogonal each other and kept in place under the elasticity of a member of the skeleton of the wing as well as the relative tightness between the projections and the portions receiving the projections.

BRIEF DESCRIPTION OF THE DRAWINGS

Other objects and the advantages of this invention will be further apparent from the following detailed explanation of preferred embodiments, taken with the accompanying drawings, wherein in the various figures of the drawings, the same reference numerals designate the same elements, and wherein.

DETAILED DESCRIPTION OF PREFERRED EMBODIMENTS

Figure 1:
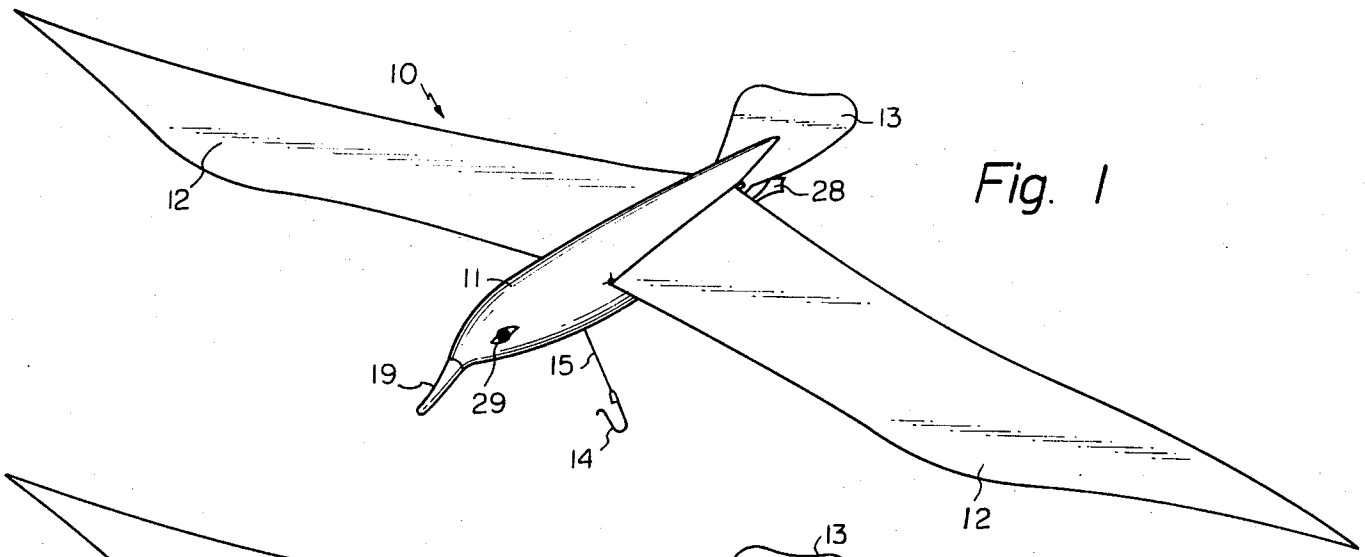
FIG. 1 is a perspective view of a preferred embodiment of this invention.

Referring to FIG. 1, there is shown a preferred embodiment according to this invention which is a kite 10 designed to simulate a sea-gull. Though the shape of a sea-gull is employed, this is just one example, and the invention is not limited to this configuration. Of course, in general, a large wing area is preferred in constructing a kite having a bird shape and, in this connection, the sea-gull is one style having such preferred characteristic.

The main parts of the kite 10 are a central body 11, a pair of wings 12, a tail 13 and a hook 14 coupled with the body by means of a string 15. The weight of the central body is preferably kept to a minimum and thus is made of as light a material as possible. Foamed polystyrol is one of the preferred materials for fabricating the body 11.

Figure 2:
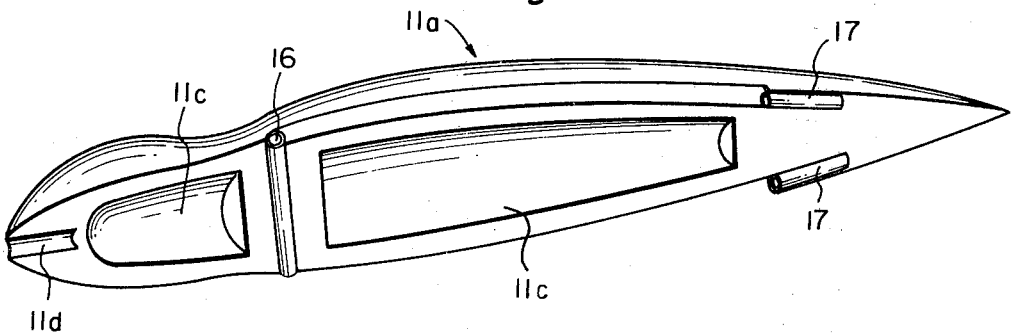
FIG. 2 is an exploded perspective view of a central body.
Figure 2:
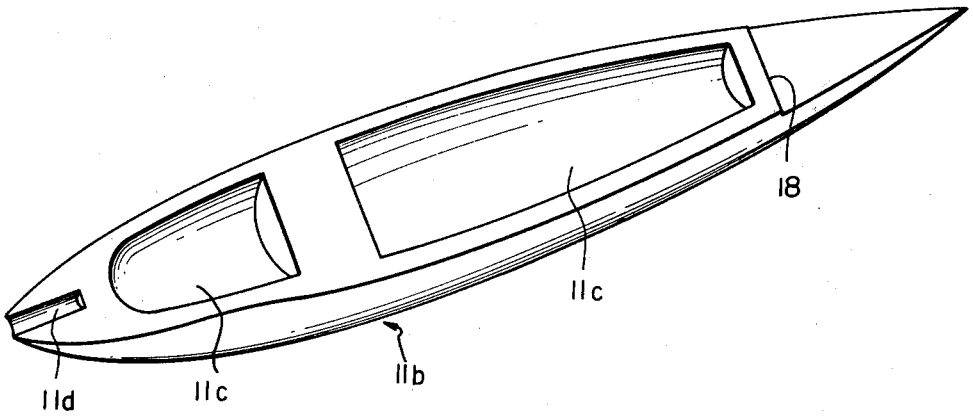

The body 11 is preferably made of two halves or segments 11*a* and 11*b* such as shown in FIG. 2 in an exploded perspective view. The upper segment 11*a* of the body 11 is further provided with a transverse tube 16 and a pair of short tubes 17, the tube 16 being arranged to extend through the body 11 when the two segments 11*a* and 11*b* are assembled by means of suitable adhesive. The short tubes 17 are disposed at the opposite sides of the upper section 10*a* so that they are in a direction substantially or nearly orthogonal to that of the tube 16. The tubes 16 and 17 are preferably made of light-weight plastic to keep their weight to a minimum and are attached to the upper segment 11*a* by suitable means such as adhesive. Although in the illustrated embodiment the tubes 16 and 17 are attached to the upper segment 11*a*, they may be alternatively attached to the lower segment 11*b*. The two segments 11*a* and 11*b* are preferably provided with a suitable number of spaced cavities 11*c* as shown to reduce their weight, however, depending on the size and volume of the segments, the number and size of these cavities may be varied, and sometimes these segments may be produced without cavities. In either one of the segments 11*a* and 11*b*, a step 18 is provided to facilitate installation of the tail 13 when the segments are glued together, (in the illustration, the step 18 is shown as provided in the lower segment 11*b*). A longitudinal groove 11*d* is preferably provided in the nose of each segment. Groove 11*d* is adapted to receive a bill 19 when the two segments 11*a* and 11*b* are assembled to simulate a sea-gull body, the bill 19 being preferably made of light material such as wood, stiff paper or plastic and glued in place.

Figure 3:
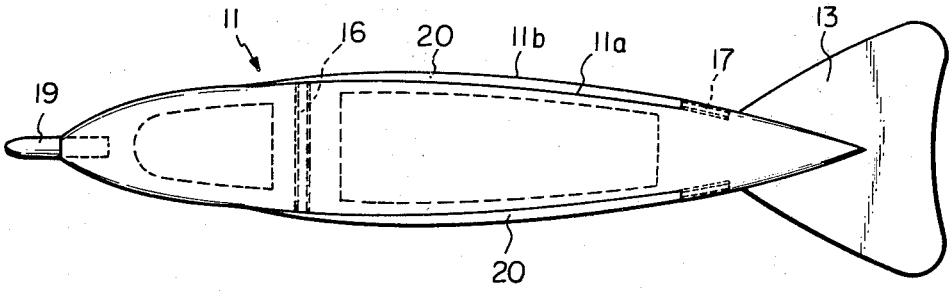
FIG. 3 is a plan view of the central body incorporating a bill and tail.

The completed plan view of the central body 11 is illustrated in FIG. 3 with the bill 19 and the tail 13 being attached. As viewed in this drawing, after the two segments 11*a* and 11*b* are assembled, the upper surface of the lower segment 11*b* is exposed at opposite sides between the tube 16 and one of the tubes 17 on the same side, respectively. To such end, the lateral width of the lower surface of the upper segment 11*a* is made narrower than that of the upper surface of the lower segment 11*b* between the position of the tube 16 and the forward end of the tubes 17. The exposed surfaces 20 of the lower segment 11*b* will be further explained in connection with the installation of the wings 12.

Figure 4:
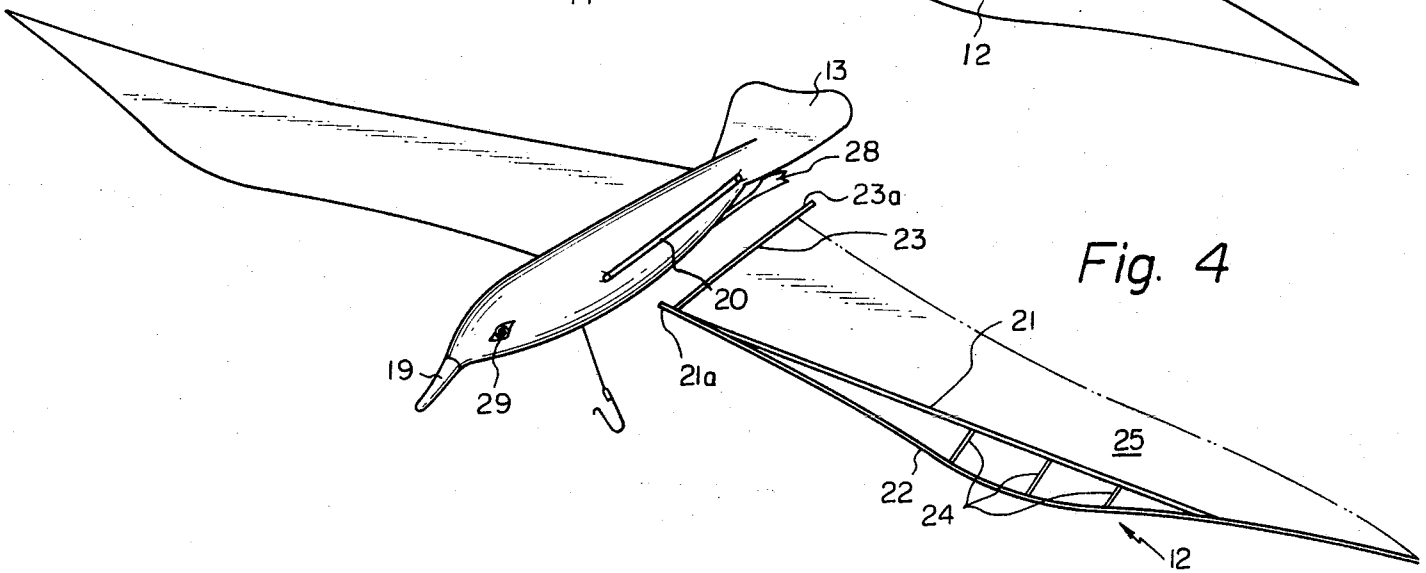
FIG. 4 is also a perspective view similar to that of FIG. 1, but with one of the wings detached from the central body and showing the structure of a wing skeleton.

The central body 11 is explained as comprising two segments referring to FIGS. 2 and 3. However, the body 11 may be produced or molded in a single unit and tubes 16 and 17, the tail 13 and the bill are attached thereto by such means as piercing, slitting and gluing etc. The wing 12 is easily attached to the central body and easily detached therefrom. Referring to FIG. 4, further details of the wing 12 will be explained. The skeleton of the wing 12 comprises a spar 21, a leading edge member 22, an installing rib member 23 and a plurality of auxiliary ribs 24. The spar 21 and leading edge member 22 coupled with the ribs 24 form the leading edge skeleton with a curve simulating the forward portion of the sea-gull wing shape. The installing rib member 23 is joined to the spar 21 with an angle of approximately 90° therebetween leaving an inward end 21*a* of the spar 21 projecting inwardly from the rib member 23. All the members constituting the wing skeleton are selected from materials which are flexible, elastic and light. Bamboo is one of the suitable materials, however, any material such as wood or plastic may be used provided that it is light and elastic. The outer end of the leading edge member 22 is preferably extended beyond the outer end of the spar 21. The spar 21 is made slender, thinner or tapering from the inner end toward the outer end so that it is more pliant or flexible. The inward end 21*a* of the spar is dimensioned so that it is press fitted within the tube 16 when it is inserted thereinto. If the tube 16 is made from pliable plastic, the cross section of the inward end 21*a* of the spar is not necessarily circular and may be square or triangle with rounded edges, since the pliable tube 16 deforms and conforms to the cross sectional shape of the inward end 21*a* when it is press fitted into the tube 16.

Over the skeleton illustrated in FIG. 4 which is constructed as explained above, a thin and light sheet member 25 is stretched to form a wing surface so that the combination of the skeleton and the sheet member 25 resembles the sea-gull wing. The trailing edge line thereof is illustrated in FIG. 4 by a chained line extending from the rib member 23 to the outward tip end of the leading edge member 22. As illustrated in FIG. 4, intersection of the trailing edge of the sheet member (shown in the chained line) with the rib member 23 starts at the point short of the rear end of the rib member 23, thereby leaving the end 23*a* thereof projecting rearwardly from the trailing edge of the sheet member 25. The sheet member 25 is preferably made of light thin material such as nonwoven fabric, paper etc. Nonwoven fabric has been found to be preferable, since it is water-resistant and has good affinity for ink and paint making it possible to print an authentic bird wing pattern thereon. Also, a water-proof or water resistant material makes it possible to use the kite without much concern when the user wishes to fly the kite at the sea shore or lake side.

The wing 12 thus completed as described above may be easily attached to the central body 11 in the following manner. The rearward end 23*a* of the rib member 23 is dimensioned so that it is freely or easily inserted into the forward opening of the tube 17. In other words, the tube 17 loosely or slidingly receives the end 23*a*. At first, the rearward end 23*a* of the rib member 23 is inserted into the tube 17 substantially parallel to the longitudinal axis of the central body 11. Then, the inward end 21*a* of the main spar 21 is snugly inserted into the tube 16 in a press fit relationship so that the projecting end 21*a* is fully inserted into the tube 16 and the rib member 23 warps to agree with the curved shape as viewed in FIG. 3 and nests on the exposed surface 20 together with the adjacent area of the sheet member 25 between the tubes 16 and 17. Since the directions of the inward end 21*a* of the spar and the rearward end 23*a* are substantially orthogonal with respect to each other and, with the tight fit between the end 21*a* and the tube 16, the wing 12 is firmly secured to the central body 11. Such firm fit is further enhanced by virtue of the warpage of the flexible rib member 23 closely conforming to the curve of the side surface of the upper section 11*a* under the stressed condition as well as nesting on the exposed surface 20. The possibility of a gap between the wing 12 and the central body is also effectively prevented by the existence of the exposed surface 20, thereby promoting the aerodynamic characteristic of the kite.

If it is desired to remove the wing 12 from the body 10, the inward end 21*a* is pulled outwardly, and then the rearward end 23*a* is pulled forwardly.

Figure 5:
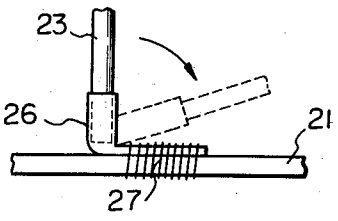
FIG. 5 is a fragmentary view of the pivotable joint portion of the wing skeleton.

The joint of the rib member 23 and the main spar 21 may be made by any suitable means. Also, if it is preferred for carrying purposes to fold the removed wing 21, the joint construction illustrated in FIG. 5 may be suitable. In this joint construction, the forward end of the installing rib member 23 is inserted half-way into a pliable tube 26, and the rest of the tube 26 is bent and attached to the spar 21 by winding strings 27 or with adhesive, etc. With this construction, the installing rib member 23 may be easily pivoted so as to become parallel to the spar 21 because of the pliability of the tube 26. Any other suitable pivoting joint may be substituted for the tube 26.

In flying the kite 10, a string is attached to the hook 14 and the string is extended as the wind blows against the wings. Since the skeleton of the wing is flexible, both wings flap depending on the strength of the wind, manually pulling or running with the string attached to the hook 14. The flapping of the wings thus simulates the flying bird, thereby exhibiting an authentic and attractive appearance during flight as viewed from the ground. Also, the sheet material 25 is only supported at the leading edge and the installing rib member 23. Thus, almost all the surface of sheet material 25, except those portions attached to the skeleton as above described are left free, whereby the major part of the sheet member also easily flaps during flight and this enhances the authentic appearance of the kite. The outward portion of the leading edge member 22 extending beyond the outer end of the spar 21 also assists such flapping, since the outward portion is supported as a cantilever and is thus also flexible.

Figure 6:
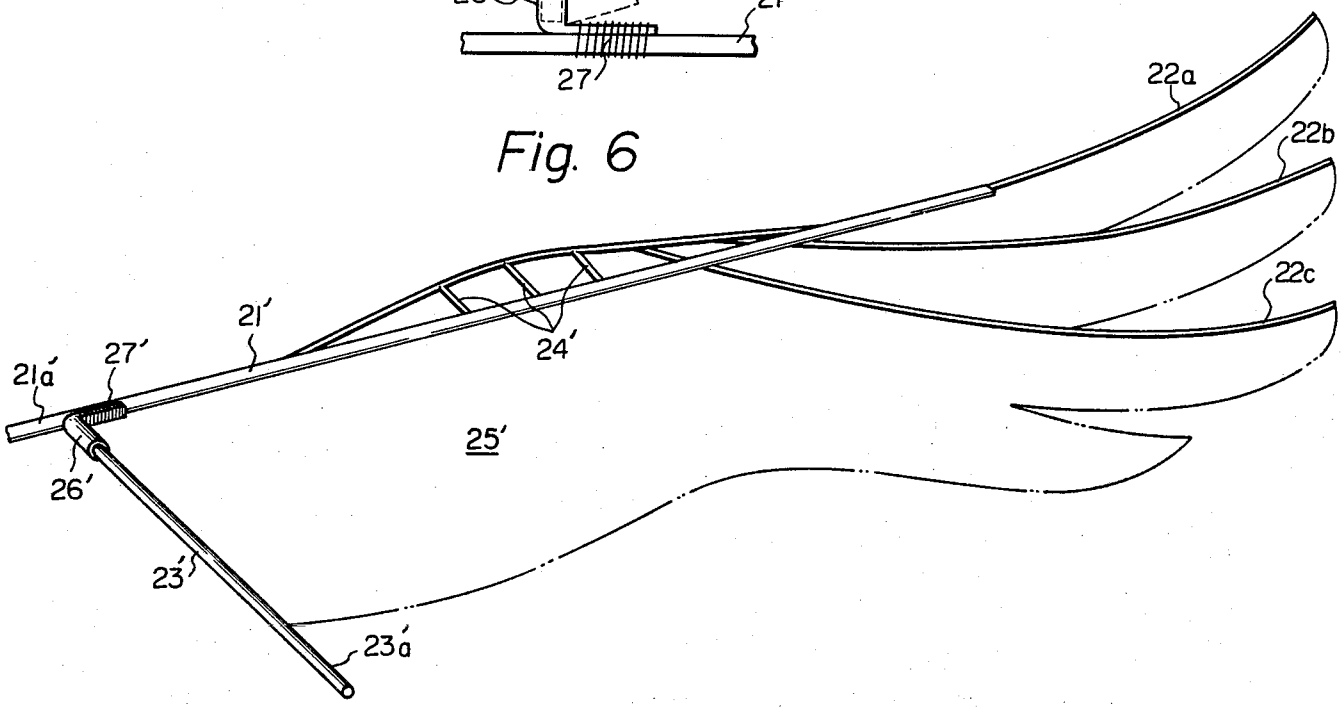
FIG. 6 is a perspective view of a modified wing.

Although the kite 10 has been explained with reference to an embodiment simulating a sea-gull, the shape of the kite is not intended to be so limited. For example, in FIG. 6 there is illustrated an example of a modified wing structure which is a simulation of an eagle wing, and the same reference numerals as empolyed in the illustration of the sea-gull wing 12 are given to each member similar to that of the wing 12, but with a prime added thereto, except for separate wing tips *22a*, *22b* and *22c* of the leading edge member. The wing tips *22a*, *22b* and *22c* are arranged to resemble an eagle wing. Alternatively, an appropriate pattern simulating an actual bird wing may be printed on the wing.

In order to increase the resemblance to an actual bird, feet or web feet 28 and eyes 29 may be disposed on the body 10 at appropriate places.

Because the kite of this invention is constructed as above it gives an authentic appearance and exhibits flapping action while in flight, thereby providing enjoyment to the person flying the kite. Further, the kite of this invention can be fabricated economically. Also the detachable wings make the kite handy and easy to carry.

The invention has been explained in detail referring to the illustrated embodiments, however, it should be understood that the invention is easily modified or changed by those skilled in the art within the scope and spirit of the invention defined in the annexed claims.

What is claimed is:

1. A kite comprising:

a longitudinally extending central body formed of a lightweight material;

a first tube extending through said body transversely of the longitudinal axis thereof;

a pair of second tubes disposed on opposite sides of said body and extending in directions substantially parallel to said longitudinal axis of said body; and a pair of wings, each said wing comprising a skeleton structure formed of a flexible material and a sheet material stretched over said skeleton structure to form a wing surface, said skeleton structure including a leading edge member, a spar, a plurality of auxiliary ribs extending between said leading edge member and said spar, an installing rib, a first projection adapted to be inserted into said first tube, a second projection adapted to be inserted into a respective one of said second tubes, said first projection being provided at an inward end of said spar, and said second projection being provided at a rearward end of said installing rib.

2. A kite as claimed in claim 1, wherein said spar is made thinner from said inward end thereof toward the outer end thereof.

3. A kite as claimed in claims 1 or 2, wherein said sheet material is nonwoven fabric.

4. A kite as claimed in claims 1 or 2, wherein said central body comprises an upper segment and a lower segment assembled together with said first and second tubes.

5. A kite as claimed in claim 4, wherein said upper and lower segments are made of polystyrol.

6. A kite as claimed in claim 1, wherein said installing rib is joined to said spar by a pivotable joint.

7. A kite as claimed in claim 1, wherein the respective dimensions of said first projection and said second projection are arranged so that said first projection is press fit when inserted into said first tube and said second projection is slidingly fit when inserted into the respective one of said second tubes.

* * * * *